US010822732B2

(12) United States Patent
Fanesi

(10) Patent No.: US 10,822,732 B2
(45) Date of Patent: Nov. 3, 2020

(54) PROCESS FOR MAKING A SEAMLESS, REVERSIBLE TWO-COLOR JERSEY

(71) Applicant: GENTE DI MARE S.R.L., Falconara Marittima (IT)

(72) Inventor: Angelina Fanesi, Monte San Vito (IT)

(73) Assignee: GENTE DI MARE S.R.L., Falconara Marittima (IT)

( * ) Notice: Subject to any disclaimer, the term of this patent is extended or adjusted under 35 U.S.C. 154(b) by 339 days.

(21) Appl. No.: 15/779,696

(22) PCT Filed: Dec. 22, 2016

(86) PCT No.: PCT/EP2016/082396
§ 371 (c)(1),
(2) Date: May 29, 2018

(87) PCT Pub. No.: WO2017/114751
PCT Pub. Date: Jul. 6, 2017

(65) Prior Publication Data

US 2020/0308748 A1 Oct. 1, 2020

(30) Foreign Application Priority Data

Dec. 30, 2015 (IT) ..... 102015000089256

(51) Int. Cl.

| | |
|---|---|
| ***D06B 11/00*** | (2006.01) |
| ***A41D 1/04*** | (2006.01) |
| ***D04B 1/24*** | (2006.01) |
| ***A41D 15/00*** | (2006.01) |

(52) U.S. Cl.
CPC ..... *D06B 11/0089* (2013.01); *A41D 1/04* (2013.01); *A41D 15/005* (2013.01); *D04B 1/246* (2013.01); *D10B 2501/04* (2013.01)

(58) Field of Classification Search
CPC .... D06B 11/0089; A41D 1/04; A41D 15/005; D04B 1/246; D10B 2501/04
See application file for complete search history.

(56) References Cited

U.S. PATENT DOCUMENTS

2010/0095709 A1* 4/2010 Ando ..... D04B 35/08 66/14

* cited by examiner

*Primary Examiner* — Amina S Khan
(74) *Attorney, Agent, or Firm* — Egbert, McDaniel & Swartz, PLLC

(57) ABSTRACT

A process for making a seamless, reversible two-color jersey, including the following steps: knitting with a whole-garment knitting machine in such manner to make a seamless reversible jersey; closing the bottom and the cuffs of the jersey, making tracks on the sides of each sleeve and of the body, dry-cleaning the jersey, removing the stains, finishing the jersey, tacking a patch on the jersey to cover the opening generated by the neck, pre-ironing the jersey, dyeing the jersey, wherein the dye color is absorbed in a different way on the external surface of the jersey and on the internal surface of the jersey, in such manner to obtain a two-color jersey, removing the patch and the seals of the bottom and of the cuffs.

10 Claims, 4 Drawing Sheets

PROCESS FOR MAKING A SEAMLESS, REVERSIBLE TWO-COLOR JERSEY

The present patent application for industrial invention relates to a process for making a seamless, reversible two-color garment. In particular, the garment can be a jersey, a pullover, a cardigan or any other type of knitwear, preferably made of valuable natural yarns, such as wool, cashmere and the like.

As it is known, a reversible (double-face) garment is a garment that can be worn inside out. Obviously, consumers mostly request reversible two-color garments, that is to say garments with different colors on the two sides of the garment.

Currently, reversible two-color knitted garments are made with linear knitting machines that use two yarns of different colors. Said yarns of different colors are knitted with a special technique, known as "vanish" knitting, wherein the yarn of a first color is disposed only on one external side of the garment and the yarn of the second color is disposed only on one internal side of the garment. The two-color garment that comes out of the knitting machine is a planar sheet that is then closed with seams in order to obtain the tubular shape that is typical of the body and of the sleeves of the garment. The hanging yarns of the garment coming out of the knitting machine are then looped in the seams.

Knitting machines have been recently introduced on the market, which are able to directly make a knitted garment with tubular shape, without any final seam used to close the garment with tubular shape.

Said knitting machines are known with the WHOLEGARMENT® trademark and are sold and marketed mainly by the Japanese company called SHIMA SEIKI. The wholegarment knitted technology allows for making a complete garment, directly in the machine, practically ready to wear with any looping operations and seams.

EP1672105 discloses a process for knitting a knitwear garment with sleeves using a wholegarment knitting machine without making seams.

However, wholegarment knitting machines are not capable of making "vanisè" fabric, that is to say with yarns of different colors respectively disposed on the internal side and on the external side of the garment. Therefore, the current wholegarment knitting machines can make a reversible knitwear garment, but cannot make a garment with different colors on the two sides.

U.S. Pat. No. 6,006,550 discloses a process for making a reversible knitted fabric having a first surface of a first color and a second surface of a second color.

DE10127740 discloses a process for making a two-color fabric; said process provides for obtaining a two-color effect by twisting different parts of fabric in such manner that these parts cannot be reached by any dye.

WO2005/028731 discloses a process for making a fabric comprising an internal side of a first color and an external side of a second color, which is different from the first one; said process provides for obtaining a two-color effect by spraying two different dyes on the internal side and on the external side of the fabric.

The purpose of the present invention is to eliminate the drawbacks of the prior art by disclosing a process for making a reversible two-color knitwear garment, which uses a wholegarment knitting machine, that is a knitting machine that delivers a finished garment, without the need to loop the fabric and make seams to obtain the finished product.

Another purpose is to provide such a process that is able to provide an aesthetically pleasant seamless garment.

These purposes are achieved by the present invention with the characteristics of the independent claim 1.

Advantageous embodiments will appear from the dependent claims.

In order to achieve the desired purpose, the applicant has revolutionized the traditional production, and has made numerous tests on a wholegarment knitting machine to improve the process for making a reversible two-color garment with wholegarment machines.

Additional features of the invention will appear clearer from the detailed description below, which refers to merely illustrative, not limiting embodiments, wherein:

With reference to the Figures, the process for making a reversible two-color garment according to the invention is disclosed.

A wholegarment knitting machine is used for knitting the jersey that forms the garment. Said machine is very sensitive to yarn count and even slightly different yarn counts can create considerable problems when knitting.

Therefore the first step of the process provides for searching for the ideal yarn. The yarn must be coarse, that is natural and not worked, and suitable for being dyed, that is a yarn of a neutral white or light grey color ready for dyeing, since the garment will be dyed successively.

Before purchasing a yarn, the yarn count is examined in order to make sure that the yarn count exactly respects the count used to set the wholegarment knitting machine. For illustrative purpose, a coarse wool yarn with Nm 2/30 yarn count is used.

A technology has been studied for setting the wholegarment knitting machine, which allows for obtaining a reversible two-color garment.

Figure 1:
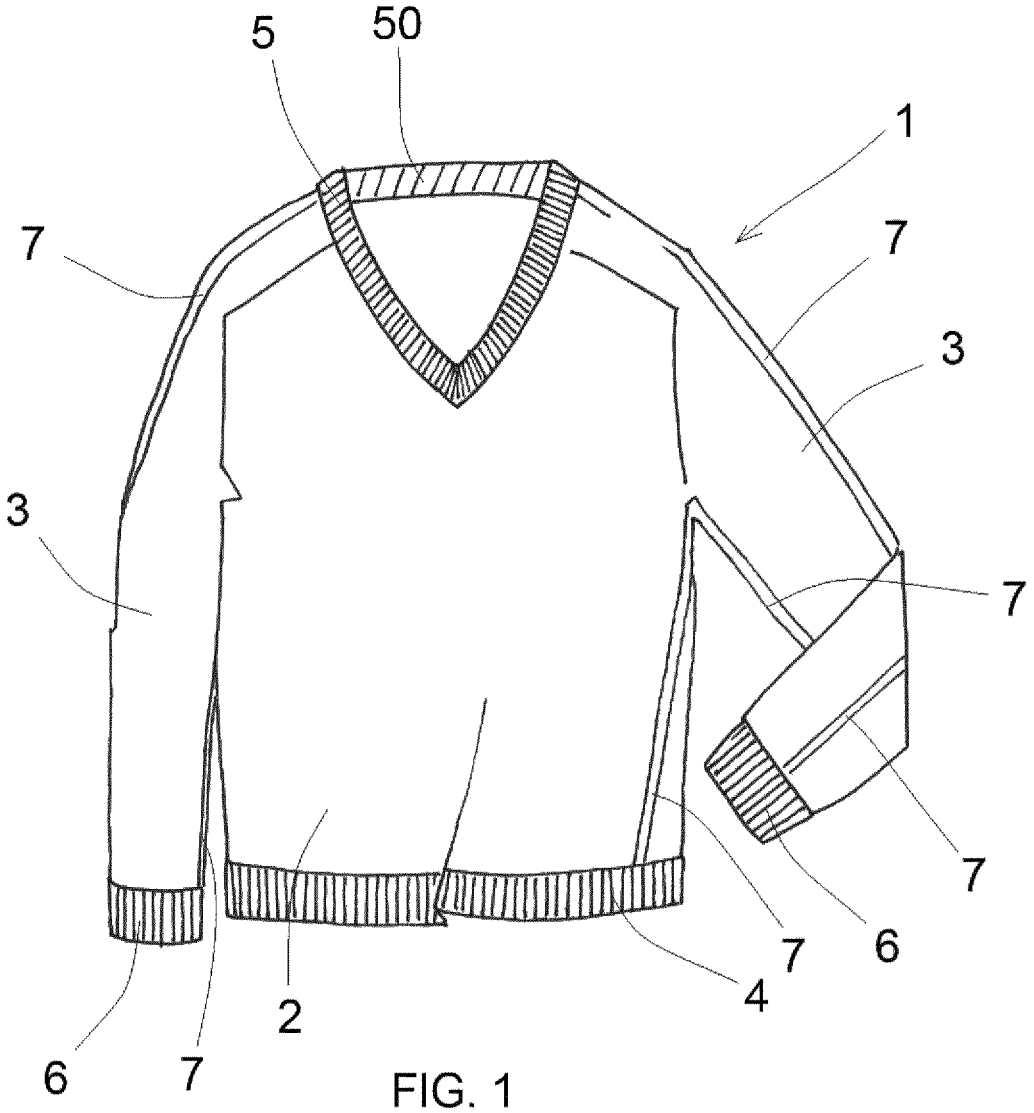
FIG. 1 is a plan view of a jersey coming out of a wholegarment knitting machine that is set for the process of the invention.

With reference to FIG. 1, the wholegarment knitting machine directly makes, without any seams, a jersey (1) with a tubular body (2) and two tubular sleeves (3) connected to the tubular body (2) at the shoulder height.

The tubular body (2) has a bottom (4) and a neck (5). The sleeves (3) have cuffs (6).

The wholegarment knitting machine is set in such a way that the bottom (4) and the cuffs (6) of the knitted garment are closed and sealed during the knitting step. On the contrary, the neck (5) is left open.

For illustrative purposes, FIG. 1 shows a "V" neck (5). In the "V"-neck version, the neck is knitted with Links process, wherein the plain stitch is the same as the purl stitch and with inlays on the back part (50) of the neck. Evidently, also the bottom (4) and the cuffs (6) can be knitted with Links process.

Advantageously, the bottom (4), the cuffs (6) and the neck (5) are thicker with respect to the rest of the jersey. Such thickening of the bottom (4), of the cuffs (6) and of the neck (5) is obtained during knitting by re-twisting the primary wool yarn with a more elastic synthetic yarn, for example Lycra or other elastic fibers, in such manner to obtain thicker bottoms, cuffs and necks with respect to the rest of the jersey in order to ensure better wearability and longer life of the garment. However, if Lycra fibers are used to thicken the bottom (4), the cuffs (6) and the neck (5), it must be considered that Lycra does not absorb the color during dyeing. Therefore the Lycra yarn must be already colored with a very color that is similar to the final color of the garment to be obtained.

The wholegarment knitting machine is set in such a way to make a strip of fabric called track (7), on the sides of each sleeve (3) and on the sides of the body (2) of the jersey. Each track (7) is made by working with purl needles alternated with plain needles. In other words, the making of each track (7) provides that a working change is made on each sleeve (3) and on the sides of the body (2), alternating plain needles with purl needles. The function of the tracks (7) is to avoid problems in the following dyeing step. In fact, the color of the dye tends not to be absorbed correctly on the folded sides of each sleeve (3) and of the body (2) of the jersey, creating a non-uniform color in the jersey. Although they absorb a color that is slightly different with respect to the rest of the jersey, because of the different type of knitting, the tracks (7) look like a special decorative pattern.

The wholegarment knitting machine can also make eyelets and/or pockets. In fact, the successive making of pockets and eyelets with looping, as usual, would involve the application of seams that do not allow the garment to be reversible and seamless.

Figure 2:
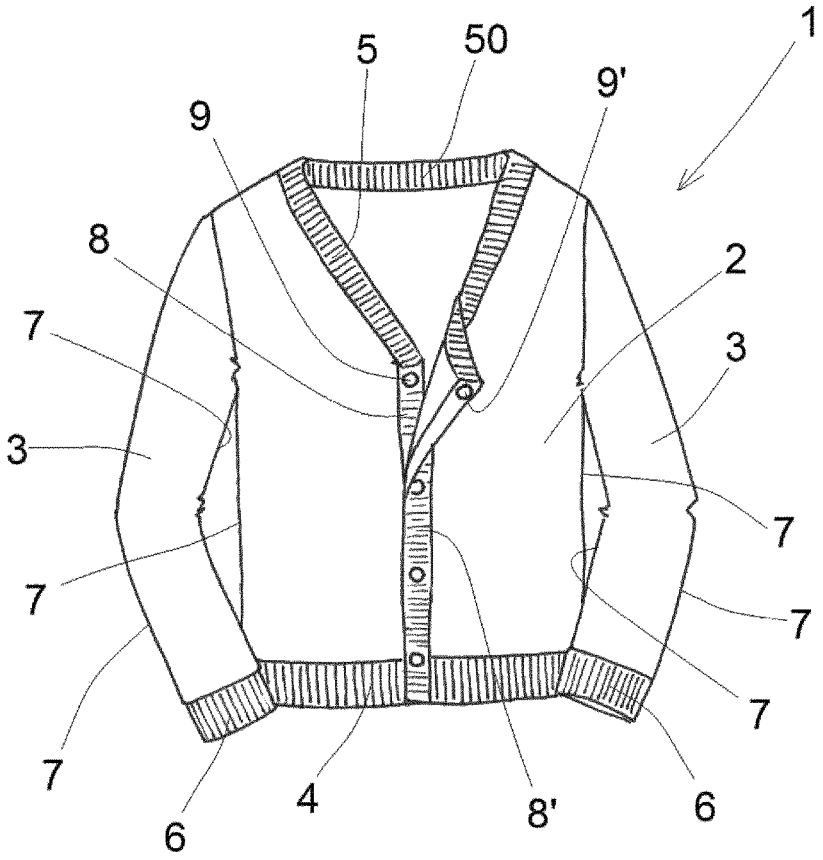
FIG. 2 is the same view as FIG. 1, except in that it shows a cardigan.

FIG. 2 shows a knitted garment (1) consisting in a cardigan. In such a case, two longitudinal borders (8, 8') going from the neck (5) to the bottom (4) are situated in the front part of the body (2). In such a case, eyelets (9, 9') are made on the longitudinal borders (8, 8') on both sides of the jersey.

Figure 3:
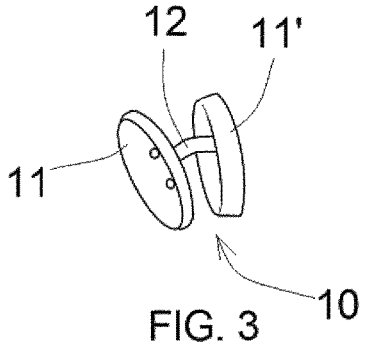
FIG. 3 is a perspective view of the a cuff link for the cardigan of FIG. 2.

With reference to FIG. 3, a cuff link or a double button (10) is applied to the eyelets (9, 9') of the cardigan. The cuff link (10) comprises a first button (11) and a second button (11') connected by a connection thread (12). In this way the first button (11) is engaged in the eyelet (9) of the first longitudinal border of the jersey and the second button (11') is engaged in the eyelet (9') of the second longitudinal border of the jersey.

The jerseys (1) coming out of the wholegarment machine have oil residues from the machine and stains. For this reason the jerseys (1) are checked and the stains are removed with trichloroethylene. Then they are dry-cleaned to eliminate the oil residues from the knitting machines.

After dry-cleaning, the jersey (1) is finished. The main difference between a standard finish and the finish obtained with the process of the invention is that:

- in the normal standard finish, the long yarns that protrude from the jersey are fixed inside the seams;
- instead, in the process according to the invention, given the fact that the jersey (1) has no seams, the long yarns that protrude from the jersey are used to recreate the warps. This process is completely made by hand with needle and thread. In other words, using a needle, an operator will manually take the long yarns that protrude from the jersey and tie them in the same way as the automatic knitting of the jersey.

Moreover, the separation yarns used by the wholegarment machine to seal the bottom (4) and the cuffs (6) of the jersey during knitting must be manually tied to prevent the risk of breaking the yarns during the dyeing step.

The only part of the jersey (1) that remains open after knitting is the neck (5).

Figure 4:
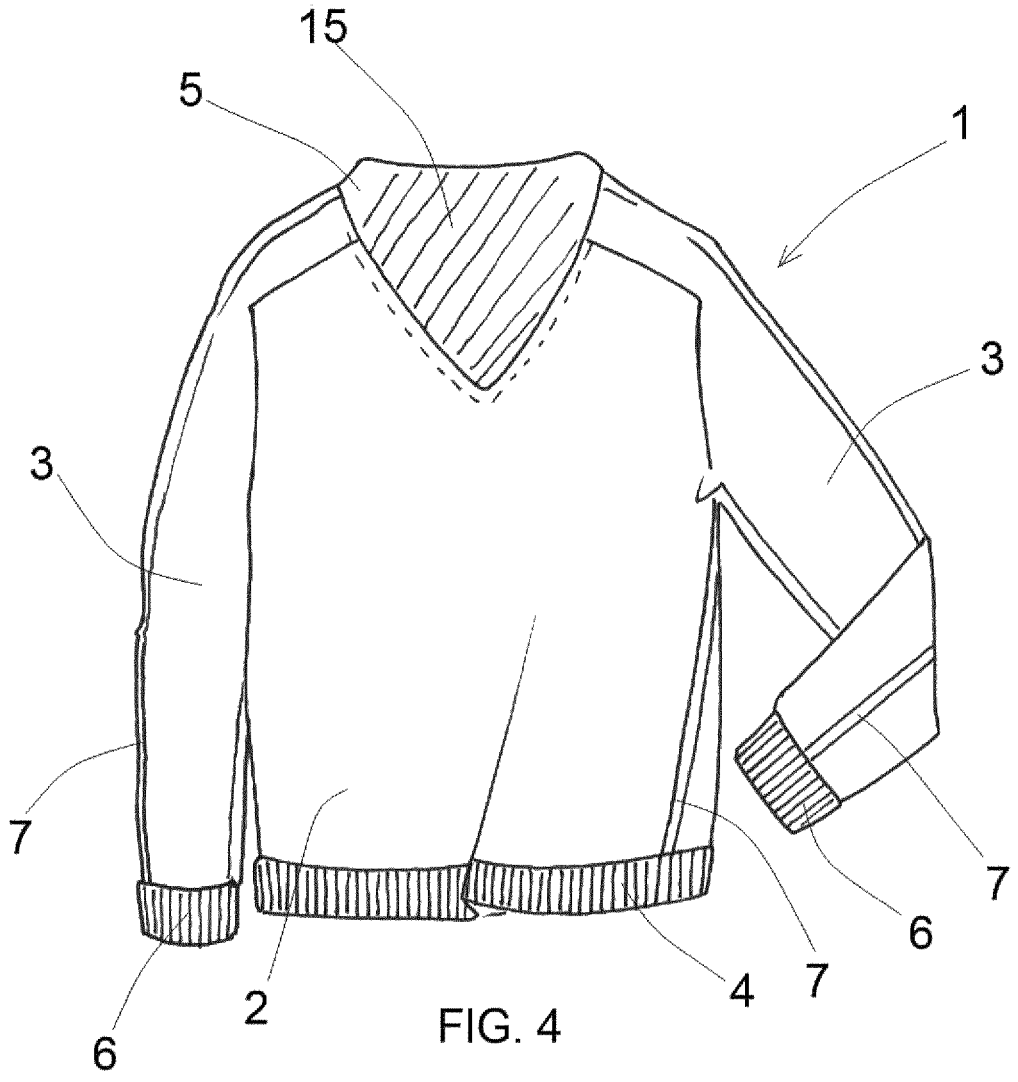
FIG. 4 is the same view as FIG. 1, except in that it shows the garment after the application of a patch to close the neck and seal the cardigan.

With reference to FIG. 4, a patch (15) is applied on the neck (5) to completely seal the jersey (1). The patch (15) has the same dimensions as the opening of the neck (5). The patch (15) is applied on the neck (5) with a tacking machine.

Advantageously, the patch (15) is made with the same yarn as the jersey (1) to prevent different yarns from absorbing the color in a different way during the dyeing step. This prevents the risk that the garment will have a different final color compared to the expected one.

The yarn used to tack the patch (15) must be very thin, in such manner that no colorless spots are left in correspondence of a tacking thread. For illustrative purposes, a 100% polyester GUTERMAN120 yarn is used.

After dry cleaning, finishing and tacking, the garment is pre-ironed. In fact, a pre-ironing step is necessary to obtain perfect dyeing.

The jersey (1) must be ironed on the tracks (7) made during the knitting step with the wholegarment machine.

The cuffs (6) and the bottom (4) of the jersey must be ironed in order to be enlarged and have the same width as the body (2) and the sleeves (3). In fact, the application, during the knitting step, of the thickening elastic fiber in the cuffs (6) and in the bottom (4) tends to make the cuffs (6) and the bottom (4) of the jersey tighter, with the risk of causing color accumulations in the cuffs (6) and in the bottom (4) during the dyeing step.

Such pre-ironing step also provides for press ironing to eliminate the creases formed on the jersey (1)

After the pre-ironing step, the jerseys are dyed with different dyeing cycles in a rotating dyeing tank.

Different types of dyeing can be used. For illustrative purposes, three examples of dyeing are mentioned below.

Example 1 (Frosted Effect on one Side of the Jersey)

The sealed jersey is introduced in the dyeing tank and a first dyeing cycle is made using a washed-effect (frosted) dye. Considering that the jersey (1) is sealed, during said first dyeing cycle, a frosted dye coating is deposited only onto the external surface of the jersey.

Successively the jersey is extracted from the dyeing tank, the neck of the jersey is opened, removing the patch from the neck of the jersey and the jersey is turned inside out in such manner that the frosted dye is situated on the internal surface of the jersey. Now the inside out jersey is introduced again in the washing tank and a second dyeing cycle is made with a colored dye of type of color.

Considering that the frosted dye coating (contained on the internal surface of the jersey) absorbs less color than the external surface of the jersey, which is without frosted dye coating, during the second dyeing cycle, the colored dye will be absorbed more on the external surface of the jersey, which is without the frosted dye coating. Therefore a non-frosted (united) effect is obtained on the external surface of the jersey; on the contrary, a frosted effect is obtained on the internal surface of the jersey. In such a way, a two-color knitted garment is obtained.

Example 2 (Blue Mist Effect on one Side of the Jersey)

In this example, instead of the frosted dye, a blue mist (indigo) dye is used, which has the same modes as the frosted dye, except in that the blue mist coating only absorbs the indigo dyes.

In the first dyeing cycle, the sealed jersey is dyed using a blue mist in such manner that a blue mist dye coating is obtained on the external surface of the jersey.

Then the jersey is extracted from the dyeing tank, the neck is opened and the jersey is turned inside out. The inside out jersey is introduced in the dyeing tank for a second dyeing cycle using a colored dye, for example a beige dye.

Consequently, a beige color is obtained on the external surface of the jersey, whereas the internal surface of the jersey has an indigo color because the blue mist coating only absorbs the indigo color, but not the beige color.

Example 3 (Pure Two-Color on the Two Sides of the Jersey)

In order to obtain a pure two-color finish with two different colors, the tacking of the patch (15) is not carried out before dyeing, meaning that the neck (5) of the jersey is left open.

During a first dyeing step, the jersey (1), with the neck open, is dyed in a tank with a base color, for example orange. In this way a uniformly colored jersey with the base color both inside and outside is obtained.

Then the jersey colored with the base color is dried and the patch (15) is applied with tacking to close the neck and seal the jersey.

Therefore the jersey, which is colored with the base color and completely sealed, undergoes a second dyeing step in a tank with a frosted dye, that is a dye that does not absorb other colors. For example, a frosted blue dye can be used in combination with the base orange color to give a brown color. As a result, a brown frosted dye coating is created on the external surface of the jersey.

Likewise in the previous cases, the jersey is extracted from the tank, the neck is opened and the jersey is turned inside out in such manner that the frosted dye coating is situated inside the jersey. Then a third dyeing cycle is made with a colored dye, for example of gray color. As a result, a gray color is obtained on the external surface of the jersey. On the contrary, the brown color remains on the internal surface of the jersey with the frosted dye coating that does not absorb the gray color.

In this way a pure two-color (gray and brown) is obtained respectively on the two sides of the jersey.

At the end of the dyeing step, the patch (15), which was applied during tacking, and the seals of the bottom and of the cuffs, which were applied during knitting, are removed.

The dyeing process, wherein the jerseys are rotated in a drum inside a dyeing tank, can pull threads or make holes. Therefore quality control is necessary to check the integrity of the garments, cut the threads ad mend the holes by recreating the warps by hand.

Figure 5:
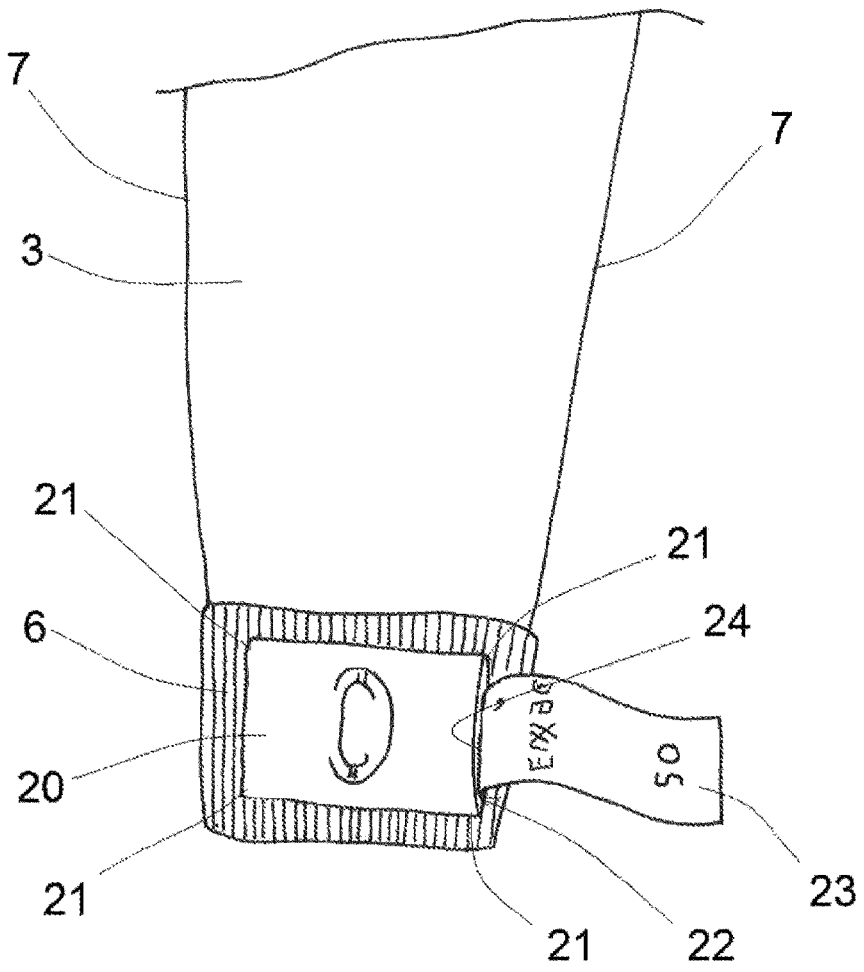
FIG. 5 is a plan view of a sleeve of a garment obtained with the method according to the invention, showing a label.

Being a reversible garment, brand labels or composition/washing labels cannot be applied, like in a non-reversible garment. For such a purpose, as shown in FIG. 5, a brand label (20) has been studied wherein a composition/washing label (23) is sewn only on one peripheral edge, Then the brand label (20) is applied with four hand stitches (21), on the inside of the cuff (6) of the sleeve of the jersey. In such a way a pocket (22) is created between the cuff (6) and the brand label (20). The composition/washing label (23) is concealed in the pocket (22) between the cuff (6) and the brand label (20). In order to see the composition/washing label (23), the user can pull out the composition/washing label (23) from the pocket (22), as shown in FIG. 5.

Numerous variations and modifications can be made to the present embodiments of the invention, which are within the reach of an expert of the field, falling in any case within the scope of the invention as disclosed by the attached claims.

The invention claimed is:

1. Process for making a seamless, reversible two-color jersey, comprising the following steps:

selection of a coarse yarn suitable for being dyed;

knitting with a knitting machine using said coarse yarn in a manner to make a seamless reversible jersey, wherein said jersey comprises a tubular body and two tubular sleeves connected to the tubular body at shoulder height; the tubular body having a bottom and a neck; and the sleeves having cuffs;

closing and sealing the bottom and the cuffs of the jersey with said knitting machine;

making tracks on the sides of each sleeve and on the sides of the body of the jersey, wherein said track is made by said knitting machine with purl needles alternated with plain needles;

dry cleaning of the jersey coming out of the knitting machine;

manual finishing of the jersey, wherein the long knitting threads that protrude from the jersey are used to recreate the warps generated by the knitting machine;

tacking a patch on the jersey to cover the opening generated by the neck of the jersey in order to obtain a totally sealed jersey;

pre-ironing the jersey in order to spread the jersey out and avoid creases;

dyeing the jersey in order to obtain a two-color shirt;

removing the patch and the closing of the bottom and of the cuffs;

characterized in that the step of dyeing the jersey provides for putting the jersey in a tank with rotating drum, wherein the dye color is absorbed differently on the external surface and on the internal surface of the jersey.

2. The process of claim 1, comprising:

a first dyeing step of the sealed jersey with a frosted dye that does not absorb the color of another dye, in a way to obtain a frosted dye coating on the external side of the jersey;

opening the neck of the jersey and turning the jersey inside out in a manner that the frosted dye coating is situated on the inside of the jersey; and a second dyeing step of the jersey turned inside out, using a dye that is absorbed on the external surface of the jersey and is not absorbed on the frosted dye coating that is situated on the inside of the jersey.

3. The process of claim 1, comprising:

a first dyeing step with a base color, on the jersey opened in the neck without the patch, in a manner that the base color is uniformly distributed both on the external surface and on the internal surface of the jersey;

tacking the patch on the neck on the jersey in order to cover the opening generated by the neck of the jersey in a manner to obtain a completely sealed jersey;

a second dyeing step using a frosted dye that does not absorb the color of another dye, in a way to obtain a frosted dye coating on the external side of the jersey;

opening the neck of the jersey and turning the jersey inside out in a manner that the frosted dye coating is situated on the inside of the jersey; and a third dyeing step of the jersey turned inside out, using a dye that is absorbed on the external surface of the jersey and is not absorbed on the frosted dye coating that is situated on the inside of the jersey.

4. The process of claim 1, further comprising a step wherein the bottom, the cuffs and the neck are thickened by knitting with said knitting machine, re-twisting the coarse yarn with a thread made of a synthetic material that is more elastic than the coarse yarn, wherein said thread of synthetic material comprises elastic fibers.

5. The process of claim 4, wherein said thread of synthetic material is colored with a color similar to the final color of the external surface of the garment to be obtained.

6. The process of claim 1, wherein the neck, the bottom and the cuffs are knit with Links process, wherein knitting is the same as purling.

7. The process of claim 1, wherein said patch applied on the jersey during tacking to close the neck of the jersey is made with the same coarse yarn of the jersey.

8. The process of claim 1, wherein the thread used to tack the patch is a 100% polyester thread.

9. The process of claim 1, wherein pockets and/or eyelets for cuff links or double buttons are obtained in the jersey during said knitting step with the knitting machine.

10. The process of claim 1, comprising the following steps:

making of a brand label wherein a composition and washing label is sewn on only one peripheral edge;

applying the brand label with sewing stitches on the inside of the cuff of the sleeve of the jersey in order to create a pocket between the cuff and the brand label wherein said composition and washing label is disposed with the possibility of being pulled out.

* * * * *